US012546034B2

(12) United States Patent
Li et al.

(10) Patent No.: US 12,546,034 B2
(45) Date of Patent: Feb. 10, 2026

(54) DEVICE FOR CONTROLLING YARN FEEDING TENSION OF FALSE-TWIST TEXTURING MACHINE

(71) Applicant: JIANGSU XINZHANJIANG FIBER TECHNOLOGY CO., LTD., Changzhou (CN)

(72) Inventors: Zhong Li, Changzhou (CN); Jianhua Gu, Changzhou (CN); Weihong Tong, Changzhou (CN)

(73) Assignee: JIANGSU XINZHANJIANG FIBER TECHNOLOGY CO., LTD., Changzhou (CN)

( * ) Notice: Subject to any disclaimer, the term of this patent is extended or adjusted under 35 U.S.C. 154(b) by 0 days.

(21) Appl. No.: 19/270,553

(22) Filed: Jul. 16, 2025

(65) Prior Publication Data

US 2025/0341032 A1 Nov. 6, 2025

Related U.S. Application Data

(63) Continuation of application No. PCT/CN2024/085749, filed on Apr. 3, 2024.

(30) Foreign Application Priority Data

Aug. 8, 2023 (CN) ..... 202310987905.1

(51) Int. Cl.
*D01H 13/10* (2006.01)
*D02G 1/02* (2006.01)
*D02G 1/08* (2006.01)

(52) U.S. Cl.
CPC ..... *D01H 13/108* (2013.01); *D02G 1/0206* (2013.01); *D02G 1/08* (2013.01)

(58) Field of Classification Search
CPC ..... D02G 1/08; D02G 1/0206; D01H 12/108; D01H 13/108; B65H 57/003; B65H 57/04;
(Continued)

(56) References Cited

U.S. PATENT DOCUMENTS 3,930,292 A * 1/1976 Schippers ..... B65H 51/16 28/241
3,948,071 A 4/1976 Lieberman et al.
(Continued)

FOREIGN PATENT DOCUMENTS

CN 201326070 Y 10/2009
CN 103331992 A 10/2013
(Continued)

*Primary Examiner* — Anna M Momper
*Assistant Examiner* — Katelynne R Burrell

(57) ABSTRACT

A device for controlling yarn feeding tension of a false-twist texturing machine, including a support frame, whose two sides are symmetrically and rotatably provided with two support roller groups, respectively. A tensioning roller assembly is slidably arranged at an inner side of the support frame. A lifting frame assembly is slidably arranged on the support frame to drive the tensioning roller assembly to move upward. Two dustproof cover assemblies are symmetrically arranged on two side of a top of the support frame. The tensioning roller assembly includes a tensioning roller, whose outer peripheral surface is provided with annular guide channels evenly spaced apart. Both ends of the tensioning roller are respectively provided with sliders. Two sides of the support frame are respectively provided with rectangular slideways fitting the sliders. The sliders are each provided with an annular protrusion coaxial with the tensioning roller.

9 Claims, 9 Drawing Sheets

(58) Field of Classification Search
CPC ..... B65H 57/16; B65H 57/26; B65H 59/36; B65H 2701/31; B65H 59/10; B65H 59/12
See application file for complete search history.

(56) References Cited

U.S. PATENT DOCUMENTS

| | | | |
|---|---|---|---|
| 6,193,184 | B1 | 2/2001 | Hansen |
| 2001/0011690 | A1 | 8/2001 | Luyckx |
| 2008/0283567 | A1 | 11/2008 | Yang |

FOREIGN PATENT DOCUMENTS

| | | | | | |
|---|---|---|---|---|---|
| CN | 104399763 | A | | 3/2015 | |
| CN | 106876219 | A | | 6/2017 | |
| CN | 107012800 | A | | 8/2017 | |
| CN | 207659689 | U | | 7/2018 | |
| CN | 208856674 | U | | 5/2019 | |
| CN | 110950137 | A | | 4/2020 | |
| CN | 210456840 | U | | 5/2020 | |
| CN | 210480462 | U | | 5/2020 | |
| CN | 211077895 | U | | 7/2020 | |
| CN | 211470247 | U | | 9/2020 | |
| CN | 112320474 | A | * | 2/2021 | ..... B65H 57/16 |
| CN | 112337754 | A | | 2/2021 | |
| CN | 213571120 | U | | 6/2021 | |
| CN | 113321063 | A | * | 8/2021 | ..... B65H 57/06 |
| CN | 214527386 | U | | 10/2021 | |
| CN | 113697614 | A | | 11/2021 | |
| CN | 215364109 | U | | 12/2021 | |
| CN | 114226468 | A | | 3/2022 | |
| CN | 216105337 | U | | 3/2022 | |
| CN | 216272435 | U | | 4/2022 | |
| CN | 115303886 | A | | 11/2022 | |
| CN | 115490085 | A | | 12/2022 | |
| CN | 218434264 | U | | 2/2023 | |
| CN | 219058007 | U | | 5/2023 | |
| CN | 219256785 | U | | 6/2023 | |
| CN | 219442116 | U | | 8/2023 | |
| CN | 219456454 | U | | 8/2023 | |
| CN | 116695295 | A | | 9/2023 | |
| CN | 118405536 | A | * | 7/2024 | ..... B65H 59/10 |
| CN | 119079687 | A | * | 12/2024 | ..... B65H 59/10 |
| CN | 119121471 | A | * | 12/2024 | ..... D01H 13/104 |
| JP | 2005017164 | A | | 1/2005 | |
| JP | 2018177497 | A | | 11/2018 | |
| KR | 101518452 | B1 | | 5/2015 | |
| WO | 2008014705 | A1 | | 2/2008 | |

* cited by examiner

DEVICE FOR CONTROLLING YARN FEEDING TENSION OF FALSE-TWIST TEXTURING MACHINE

CROSS-REFERENCE TO RELATED APPLICATIONS

This application is a continuation of International Patent Application No. PCT/CN2024/085749, filed on Apr. 3, 2024, which claims the benefit of priority from Chinese Patent Application No. 202310987905.1, filed on Aug. 8, 2023. The content of the aforementioned application, including any intervening amendments made thereto, is incorporated herein by reference in its entirety.

TECHNICAL FIELD

This application relates to false-twist texturing machines, and more particularly to a device for controlling yarn feeding tension of a false-twist texturing machine.

BACKGROUND

False-twist texturing is a process involving first yarn heating and twisting and subsequent cooling and untwisting. The textured yarn is called "textured stretch yarn". False-twist processing is completed on a false twisting machine (often called "texturing machine"), which mainly includes three continuous stages of twisting, heat setting and untwisting. The yarn is twisted with a high twist above the softening temperature to produce plastic irreversible twisting deformation, heated to eliminate the twisting stress, and cooled to set the twisting deformation. After untwisting, the twist number of the yarn is zero, but the spiral twist left on the yarn makes the yarn fluffy, elastic and retractable. The yarn feeding tension control device is a tension control device for stabilizing the original yarn before entering the roller of the false-twist texturing machine, which can reduce yarn breakage to enhance production efficiency, and has a simple structure and convenient operation.

Chinese Patent No. 208856674U, titled "a yarn feeding tension control device for a false-twist texturing machine", disclosed a yarn feeding tension control device, which includes a column, an adjustment seat, a plurality of nuts, a plurality of tension rods and a plurality of tension rod mounting frames, where the adjustment seat is mounted on the column, the plurality of tension rod mounting frames are mounted on the adjustment seat through nuts, the plurality of tension rod mounting frames are respectively mounted with the plurality of tension rods, a side of the tension rod mounting frame is provided with a mounting frame thread, the nut is provided with a nut thread, and the tension rod mounting frame thread is in fit with the nut thread.

Existing tension control devices have poor threading performance, cumbersome tension adjustment, and monotonic operational modes, which render them inadequate for meeting the demands of specific workshop scenarios. Therefore, a device for controlling yarn feeding tension of a false-twist texturing machine is proposed.

SUMMARY

An object of the disclosure is to provide a device for controlling yarn feeding tension of a false-twist texturing machine, so as to solve the problem in the prior art.

In order to achieve the above object, the following technical solutions are adopted.

This application provides a device for controlling yarn feeding tension of a false-twist texturing machine, the device comprising:

a support frame;

wherein a first support roller group and a second support roller group are symmetrically and rotatably arranged at a first side and a second side of the support frame, respectively; an inner side of the support frame is slidably provided with a tensioning roller assembly; the support frame is slidably provided with a lifting frame assembly, and the lifting frame assembly is configured to drive the tensioning roller assembly to move upward; and a first dustproof cover assembly and a second dustproof cover assembly are symmetrically arranged on tops of the first side and the second side of the support frame, respectively;

the tensioning roller assembly comprises a tensioning roller, and a plurality of annular guide channels are arranged evenly spaced apart on an outer peripheral surface of the tensioning roller; and a first end and a second end of the tensioning roller are each provided with a slider, a third side and a fourth side of the support frame are each provided with a rectangular slideway fitting the slider, and the slider is provided with an annular protrusion coaxial with the tensioning roller;

a first linkage assembly is arranged at the annular protrusion corresponding to the first end of the tensioning roller; a second linkage assembly is arranged at the annular protrusion corresponding to the second end of the tensioning roller; and the first linkage assembly and the second linkage assembly are configured to move up and down with the tensioning roller assembly to drive the first support roller group and the second support roller group to switch between an unfolded state and a folded state; and each of the first linkage assembly and the second linkage assembly comprises a cylinder rotatably arranged in the annular protrusion; an end of the cylinder is fixedly provided with a fan-shaped block; two edges of a side of the fan-shaped block are symmetrically and rotatably provided with two linkage arms; an end of one of the two linkage arms away from the fan-shaped block is rotatably connected to a side wall of the first support roller group, and an end of the other of the two linkage arms away from the fan-shaped block is rotatably connected to a side wall of the second support roller group; a locking assembly is provided inside the cylinder, and is configured to limit rotation of the cylinder relative to the annular protrusion.

In some embodiments, the support frame has a U-shaped structure; a top of the support frame is provided with a reinforcement rod; and two edges of each of the third side and the fourth side of the support frame are symmetrically provided with two lug blocks, respectively.

In some embodiments, the lifting frame assembly comprises a portal frame slidably arranged at an outer side of the support frame; two sides of the portal frame are each provided with a strip-shaped slideway corresponding to the rectangular slideway; a position of each of the two sides of the portal frame adjacent to the strip-shaped slideway is provided with an extension frame; a pressing assembly is provided inside the extension frame, and is configured to apply a pressure to the tensioning roller assembly; the pressing assembly comprises an abutting block slidably arranged in the extension frame; a lower portion of the abutting block is provided with an arc-shaped notch fitting the annular protrusion; an upper portion of the abutting block is provided with a guide rod; an upper portion of the extension frame is provided with a guide hole for the guide rod to pass through, and a position of an outer peripheral surface of the guide rod close to an inner side of the extension frame is sleevedly provided with a spring; and both sides of the upper portion of the extension frame each have a right-angle structure.

In the present disclosure, during a downward pressing process of the portal frame, the abutting block, the guide rod and the spring jointly provide a downward force to the tensioning roller assembly.

In some embodiments, each of the first support roller group and the second support roller group comprises a roller frame rotatably connected to the two lug blocks, two support arms and a support roller; and the two support arms are respectively arranged at two ends of the roller frame; and ends of the two support arms away from the roller frame are fixedly connected to the support roller.

In some embodiments, each of the first dustproof cover assembly and the second dustproof cover assembly comprises a dustproof bent plate; a side of the dustproof bent plate is provided with a metal rotating rod, and the metal rotating rod is rotatably connected to an upper portion of the inner side of the support frame; two ends of the metal rotating rod passes through the third side and the fourth side of the support frame, respectively; the two ends of the metal rotating rod are each eccentrically and fixedly connected to a circular limiting block; and an outer edge of the circular limiting block is provided with a right-angle notch.

In the present disclosure, when the dustproof bent plate is rotated upward to a stowed state, the locking between the right-angle notch and the extension frame is released. This allows the portal frame to slide upward to drive the tensioning roller assembly to move upward, thus facilitating threading operation and device maintenance. When the portal frame is pressed downward, the dustproof bent plate is rotated to a deployed state, so that the two upper corners of the extension frame are engaged with the right-angle notches, thereby restricting upward movement of the portal frame.

In some embodiments, the fan-shaped block is provided with a screw hole coaxial with the cylinder; the locking assembly comprises a first adjusting bolt rotatably arranged in the screw hole; the first adjusting bolt is insertedly arranged in the cylinder; an end of the first adjusting bolt close to an inner side of the cylinder is rotatably provided with an expansion clamping ring; the expansion clamping ring has a truncated cone structure; an outer peripheral surface of the cylinder is provided with a strip-shaped notch; a clamping block is hingedly provided inside the strip-shaped notch; and a side surface of the clamping block close to the expansion clamping ring is configured to be inclined.

In the present disclosure, the expansion clamping ring is pulled to move by rotating the first adjusting bolt to drive the clamping block to rotate and expand, thereby achieving the locking between the cylinder and the annular protrusion.

In some embodiments, an inner side of each of the first support roller group and the second support roller group is rotatably provided with a tensioning assembly; the tensioning assembly comprises a strip-shaped frame; an inner side of the strip-shaped frame is slidably provided with a movable strip; and a side of the strip-shaped frame is rotatably provided with a plurality of yarn guiding assemblies; the number of the plurality of yarn guiding assemblies is the same as the number of the plurality of annular guide channels; a first end of the strip-shaped frame is provided with a first rotating pin, and a second end of the strip-shaped frame is provided with a second rotating pin; one of the two support arms is provided with a first pin hole for the first rotating pin to pass through, and the other of the two support arms is provided with a second pin hole for the second rotating pin to pass through; and one of the first rotating pin and the second rotating pin is provided with a through hole communicated with the inner side of the strip-shaped frame; an inner side of the through hole is provided with a second adjusting bolt; an end of the movable strip is provided with a threaded hole; and the second adjusting bolt is in threaded fit with the threaded hole.

In some embodiments, each of the plurality of yarn guiding assemblies comprises a bent block rotatably connected to a side wall of the strip-shaped frame;

each of two ends of the bent block is provided with a bent portion bent toward the strip-shaped frame; the bent portion is fixedly provided with a first metal shaft; a first side wall of the bent block is fixedly provided with a side plate, and the side plate is fixedly provided with a second metal shaft; and each of the first metal shaft and the second metal shaft is rotatably provided with a V-groove pulley.

In some embodiments, a second side wall of the bent block is provided with a linkage pin, and the linkage pin is insertedly arranged in a waist-shaped hole.

In some embodiments, a lower portion of the support frame is provided with a mounting hole for fixing the support frame.

Compared to the prior art, the present disclosure has the following beneficial effects.

In the present disclosure, the lifting frame assembly can drive the tensioning roller assembly to move upward, thus facilitating threading operation and device maintenance. In addition, the coordination between the dustproof cover assembly and the circular limiting block enables locking of the lifting frame assembly. Such locking can be easily released by rotating the dustproof bent plate upward to a stowed state, resulting in convenient operation. The linkage assembly is configured to drive the tensioning roller assembly to move during the rotation of the support roller groups under force, so as to achieve varying tension effects. Additionally, the locking assembly mounted in the cylinder enables locking between the cylinder and the annular protrusion, so that the angle between the two support roller groups and the support frame is adjusted to meet diverse operational requirements. The tensioning assemblies mounted in the support roller groups allow adjustment of the angle between the yarn guiding assembly and the strip-shaped frame, resulting in a specific pulling effect on the yarn as it passes through.

Figure 1:
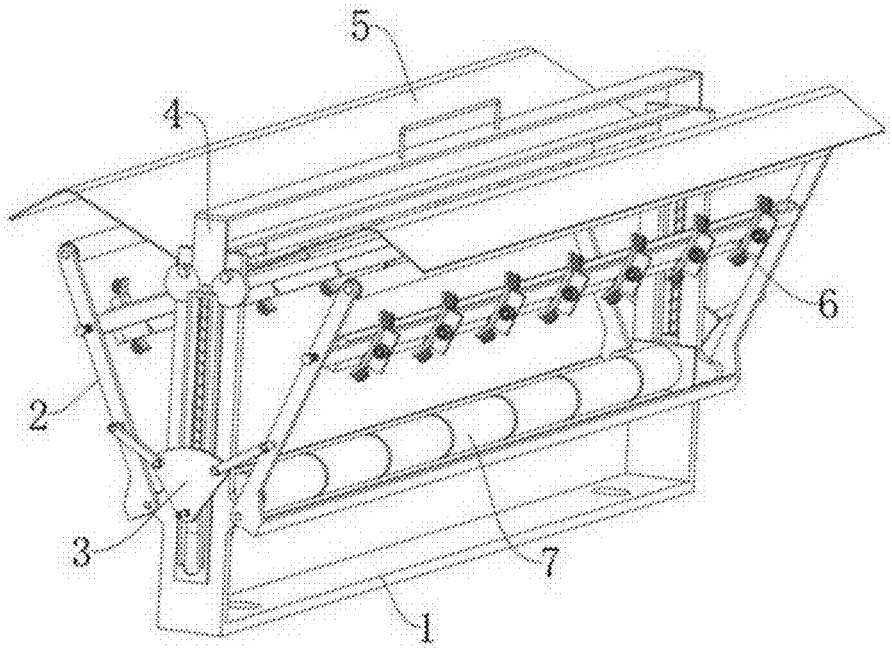
FIG. 1 is a structural diagram of a device for controlling yarn feeding tension of a false-twist texturing machine in accordance with an embodiment of the present disclosure.

In the drawings: 1. support frame; 101. lug block; 102. rectangular slideway; 103. reinforcement rod; 2. support roller group; 201. roller frame; 202. support arm; 2021. pin hole; 203. support roller; 3. linkage assembly; 301. fan-shaped block; 3011. cylinder; 3012. strip-shaped notch; 302. first adjusting bolt; 3021. expansion clamping ring; 304. clamping block; 305. linkage arm; 4. lifting frame assembly; 401. portal frame; 402. strip-shaped slideway; 4021. extension frame; 403. abutting block; 4031. guide rod; 4032. spring; 5. dustproof cover assembly; 501. dustproof bent plate; 502. metal rotating rod; 503. circular limiting block; 6. tensioning assembly; 601. strip-shaped frame; 6011. rotating pin; 602. movable strip; 6021. waist-shaped hole; 603. yarn guiding assembly; 6031. bent block; 60311. first metal shaft; 6032. side plate; 60321. second metal shaft; 6033. V-groove pulley; 604. second adjusting bolt; 7. tensioning roller assembly; 701. tensioning roller; 7011. annular guide channel; 702. slider; and 7021. annular protrusion.

DETAILED DESCRIPTION OF EMBODIMENTS

This application will be clearly and completely described below with reference to the accompanying drawings in the embodiments of the disclosure. Obviously, the described embodiments are merely some of the embodiments of the disclosure, but not all of the embodiments. Based on the embodiments of the disclosure, all other embodiments obtained by those of ordinary skill in the art without creative efforts shall fall within the scope of the disclosure defined by the appended claims.

As show in FIGS. 1-9, a device for controlling yarn feeding tension of a false-twist texturing machine is provided. The device includes a support frame 1. Two support roller groups 2 are symmetrically and rotatably arranged at first side and a second side of the support frame 1 perpendicular to a width direction, respectively. An inner side of the support frame 1 is slidably provided with a tensioning roller assembly 7. The support frame 1 slidably provided with a lifting frame assembly 4. The lifting frame assembly 4 is configured to drive the tensioning roller assembly 7 to move upward. Two dustproof cover assemblies 5 are symmetrically arranged on tops of the first side and the second side of the support frame 1, respectively.

The tensioning roller assembly 7 includes a tensioning roller 701. A plurality of annular guide channels 7011 are arranged evenly spaced apart on an outer peripheral surface of the tensioning roller 701. A first end and a second end of the tensioning roller 701 are each provided with a slider 702. A third side and a fourth side of the support frame 1 perpendicular to a length direction are each provided with a rectangular slideway 102 fitting the slider 702. The slider 702 is provided with an annular protrusion 7021 coaxial with the tensioning roller 701.

One of two linkage assemblies 3 is arranged at the annular protrusion 7021 corresponding to the first end of the tensioning roller 701, and the other of the two linkage assemblies 3 is arranged at the annular protrusion 7021 corresponding to the second end of the tensioning roller 701. The two linkage assemblies 3 are configured to move up and down with the tensioning roller assembly 7 to drive the two support roller groups 2 to switch between an unfolded state and a folded state.

Each of the two linkage assemblies 3 includes a cylinder 3011 rotatably arranged in the annular protrusion 7021. An end of each of the cylinder 3011 is fixedly provided with a fan-shaped block 301. Two edges of a side of the fan-shaped block 301 are symmetrically and rotatably provided with two linkage arms 305. An end of one of the two linkage arms 305 away from the fan-shaped block 301 is rotatably connected to a side wall of one of the two support roller groups 2, and an end of the other of the two linkage arms 305 away from the fan-shaped block 301 is rotatably connected to a side wall of the other of the two support roller groups 2. A locking assembly is provided inside the cylinder 3011, and is configured to limit rotation of the cylinder 3011 relative to the annular protrusion 7021.

Figure 2:
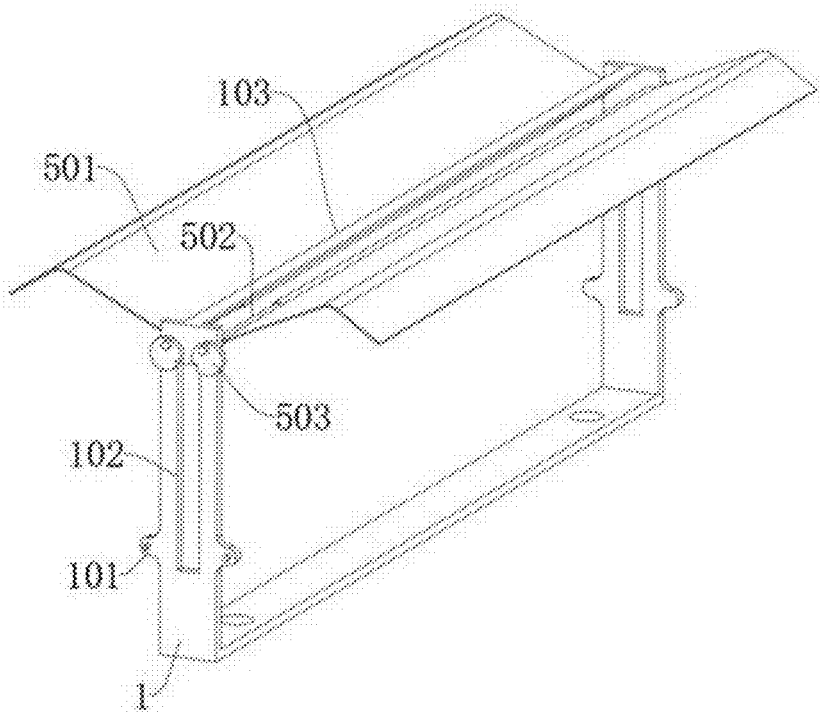
FIG. 2 is a structural diagram of a support frame and a dustproof cover assembly of the device in accordance with an embodiment of the present disclosure.

Referring to FIGS. 1 and 2, the support frame 1 has a U-shaped structure. A top of the support frame 1 is provided with a reinforcement rod 103. Two edges of each of the third side and the fourth side of the support frame 1 are symmetrically provided with two lug blocks 101, respectively.

Figure 4:
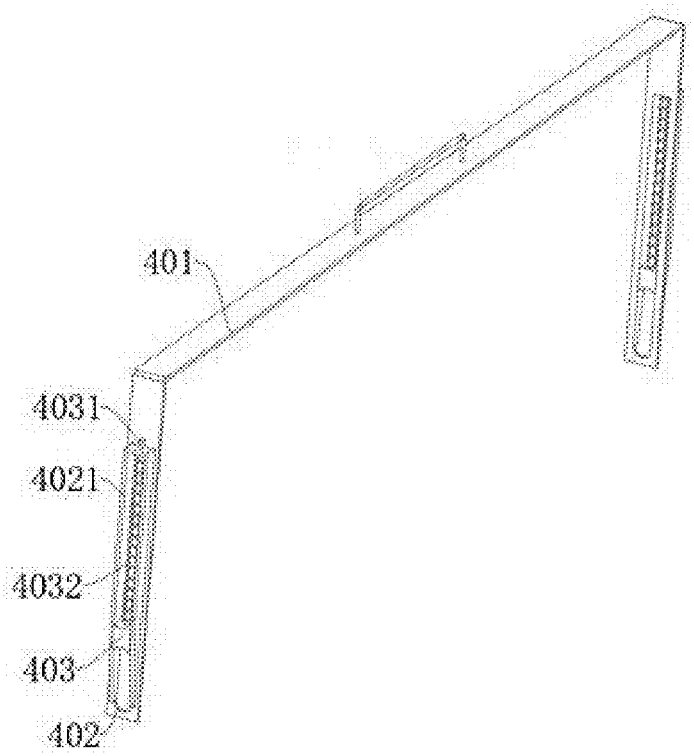
FIG. 4 is a structural diagram of a lifting frame assembly of the device in accordance with an embodiment of the present disclosure.
Figure 5:
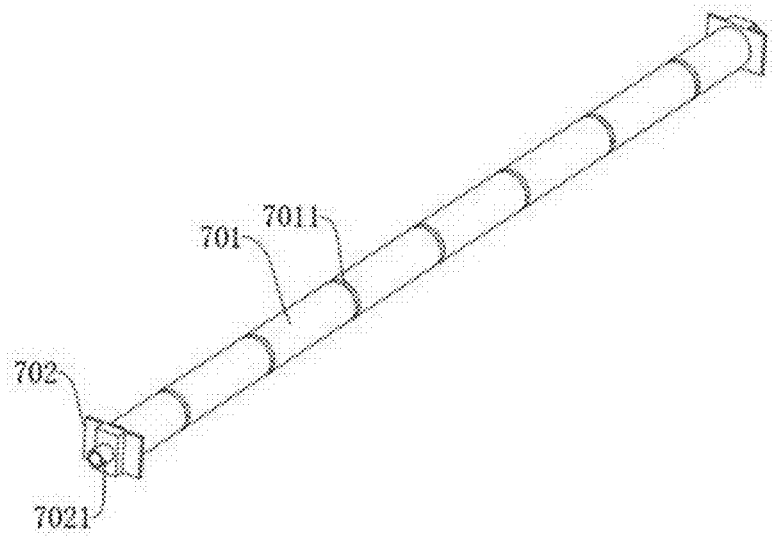
FIG. 5 is a structural diagram of a tensioning roller assembly of the device in accordance with an embodiment of the present disclosure.

Referring to FIGS. 1 and 4, the lifting frame assembly 4 includes a portal frame 401 slidably arranged at an outer side of the support frame 1. Two sides of the portal frame 401 are each provided with a strip-shaped slideway 402 corresponding to the rectangular slideway 102. A position of each of the two sides of the portal frame 401 adjacent to the strip-shaped slideway 402 is provided with an extension frame 4021. A pressing assembly is provided inside the extension frame 4021, and is configured to apply a pressure to the tensioning roller assembly 7. The pressing assembly includes an abutting block 403 slidably arranged in the extension frame 4021. A lower portion of the abutting block 403 is provided with an arc-shaped notch fitting the annular protrusion 7021. An upper portion of the abutting block 403 is provided with a guide rod 4031. An upper portion of the extension frame 4021 is provided with a guide hole for the guide rod 4031 to pass through. A position of an outer peripheral surface of the guide rod 4031 close to an inner side of the extension frame 4021 is sleevedly provided with a spring 4032. Both sides of the upper portion of the extension frame 4021 each have a right-angle structure. During the downward pressing process of the portal frame 401, the abutting block 403, the guide rod 4031 and the spring 4032 jointly provide a downward force to the tensioning roller assembly 7.

Figure 3:
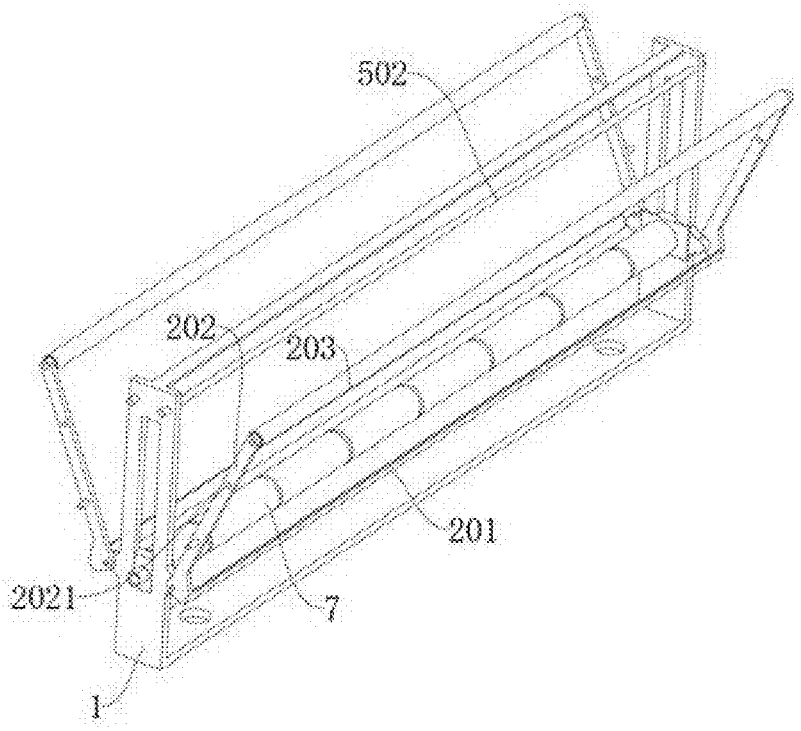
FIG. 3 is a structural diagram of the support frame and a support roller group of the device in accordance with an embodiment of the present disclosure.

Referring to FIGS. 1 and 3, each of the two support roller groups 2 includes a roller frame 201 rotatably connected to the two lug blocks 101, two support arms 202 and a support roller 203. The two support arms 202 are respectively arranged at two ends of the roller frame 201. Ends of the two support arms 202 away from the roller frame 201 are fixedly connected to the support roller 203.

Referring to FIGS. 1-3, each of the two dustproof cover assemblies 5 includes a dustproof bent plate 501. A side of the dustproof bent plate 501 is provided with a metal rotating rod 502. The metal rotating rod 502 is rotatably connected to an upper portion of the inner side of the support frame 1. Two ends of the metal rotating rod 502 respectively pass through the third and fourth sides of the support frame 1, respectively. The two ends of the metal rotating rod 502 are each eccentrically and fixedly connected to a circular limiting block 503. An outer edge of the circular limiting block is provided with a right-angle notch. When the dustproof bent plate 501 is rotated upward to a stowed state, the locking between the right-angle notch and the extension frame 4021 is released. This allows the portal frame 401 to slide upward to drive the tensioning roller assembly 7 to move upward, thus facilitating threading operation and device maintenance. When the portal frame 401 is pressed downward, the dustproof bent plate 501 is rotated to a deployed state, so that the two upper corners of the extension frame 4021 are engaged with the right-angle notches, thereby restricting upward movement of the portal frame 401.

Figure 6:
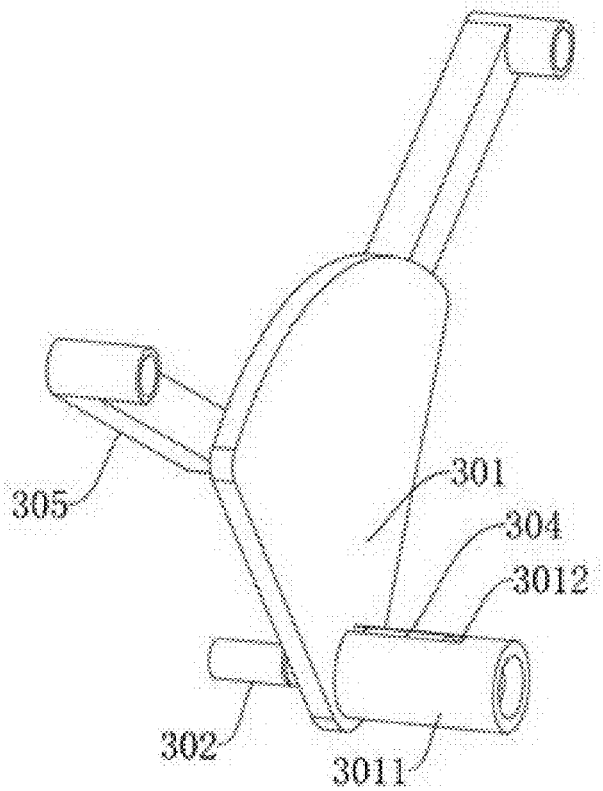
FIG. 6 is a structural diagram of a linkage assembly of the device in accordance with an embodiment of the present disclosure.
Figure 7:
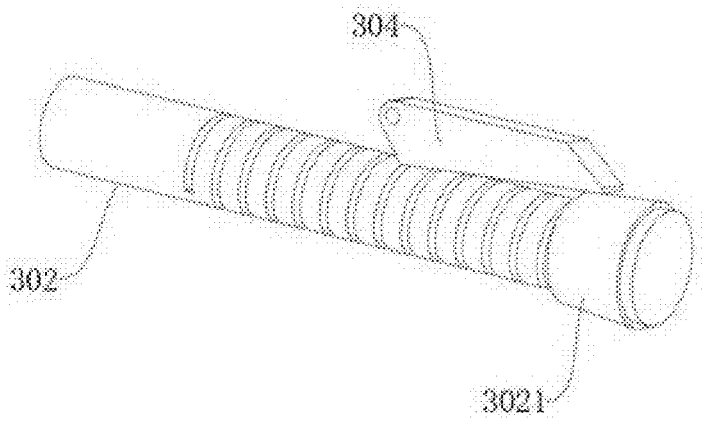
FIG. 7 is a structural diagram of a locking assembly of the device in accordance with an embodiment of the present disclosure.

Referring to FIGS. 6 and 7, the fan-shaped block 301 is provided with a screw hole coaxial with the cylinder 3011. The locking assembly includes a first adjusting bolt 302 rotatably arranged in the screw hole. The first adjusting bolt 302 is insertedly arranged in the cylinder 3011. An end of the first adjusting bolt 302 close to an inner side of the cylinder 3011 is rotatably provided with an expansion clamping ring 3021. The expansion clamping ring 3021 has a truncated cone structure. An outer peripheral surface of the cylinder 3011 is provided with a strip-shaped notch 3012. A clamping block 304 is hingedly provided inside the strip-shaped notch 3012. A side surface of the clamping block 304 close to the expansion clamping ring 3021 is configured to be inclined. The expansion clamping ring 3021 is pulled to move by rotating the first adjusting bolt 302 to drive the clamping block 304 to rotate and expand, thereby achieving the locking between the cylinder 3011 and the annular protrusion 7021.

Figure 8:
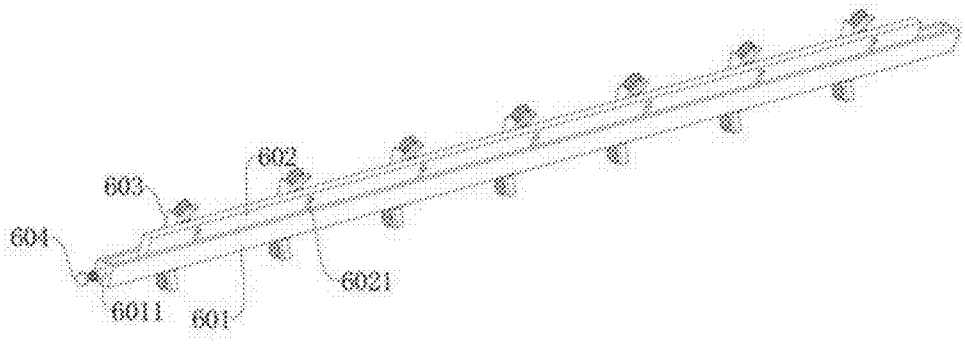
FIG. 8 is a structural diagram of a tensioning assembly of the device in accordance with an embodiment of the present disclosure.
Figure 9:
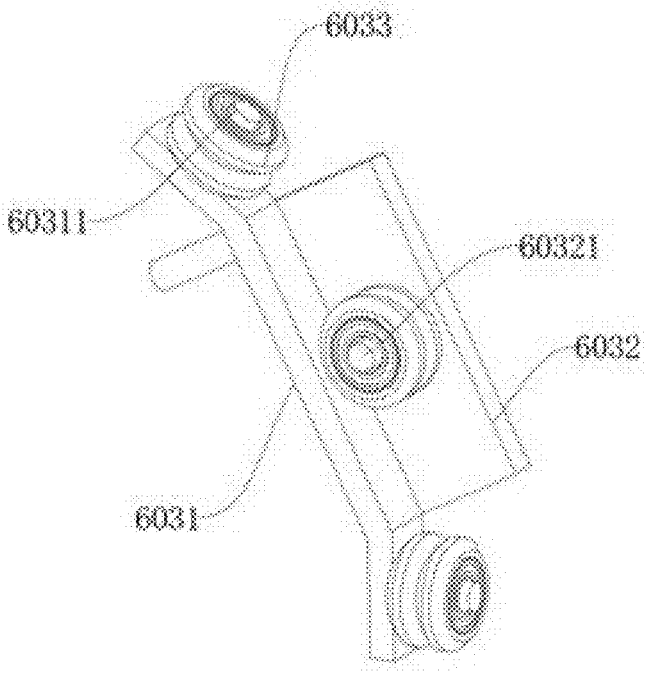
FIG. 9 is a structural diagram of a yarn guiding assembly of the device in accordance with an embodiment of the present disclosure.

Referring to FIGS. 1, 8 and 9, an inner side of each of the two support roller groups 2 is rotatably provided with a tensioning assembly 6. The tensioning assembly 6 includes a strip-shaped frame 601. An inner side of the strip-shaped frame 601 is slidably provided with a movable strip 602. A side of the strip-shaped frame 601 is rotatably provided with a plurality of yarn guiding assemblies 603. The number of the plurality of yarn guiding assemblies 603 is the same as the number of the plurality of annular guide channels 7011. A first end of the strip-shaped frame 601 is provided with a first rotating pin 6011. A second end of the strip-shaped frame 601 is provided with a second rotating pin 6011. One of the two support arms 202 is provided with a first pin hole 2021 for the first rotating pin 6011 to pass through. The other of the two support arms 202 is provided with a second pin hole 2021 for the second rotating pin 6011 to pass through. One of the first and second rotating pins is provided with a through hole communicated with the inner side of the strip-shaped frame 601. An inner side of the through hole is provided with a second adjusting bolt 604. An end of the movable strip 602 is provided with a threaded hole. The second adjusting bolt 604 is in threaded fit with the threaded hole.

Referring to FIG. 9, each of the plurality of yarn guiding assemblies 603 includes a bent block 6031 rotatably connected to a side wall of the strip-shaped frame 601. Each of two ends of the bent block 6031 is provided with a bent portion bent toward the strip-shaped frame 601. The bent portion is fixedly provided with a first metal shaft 60311. A first side wall of the bent block 6031 is fixedly provided with a side plate 6032. The side plate 6032 is fixedly provided with a second metal shaft 60321. Each of the first metal shaft 60311 and the second metal shaft 60321 is rotatably provided with a V-groove pulley 6033.

Referring to FIG. 2, a lower portion of the support frame 1 is provided with a mounting hole configured for fixing the support frame 1.

A working principle of the embodiment of the present disclosure will be described below.

During operation, the support frame 1 is mounted at an appropriate position of the false-twist texturing machine. Then, a yarn is guided around a support roller 203 of one of the two support roller assemblies 2 (i.e., corresponding to one of the first and second sides of the support frame), and threaded through three V-groove pulleys 6033 of the corresponding yarn guiding assembly 603 and routed around a lower portion of the tensioning roller 701 to sequentially thread through the corresponding annular guiding channel 7011 and the yarn guiding assembly 603 of the tensioning assembly 6 on the other side, and finally routed around the support roller 203 of the support roller group 2 corresponding to the other of the first and second sides of the support frame for egress. During the threading process, in order to facilitate threading, the two dustproof bent plates 501 can be rotated upwards to move closer relative to each other, thereby driving the corresponding circular limiting blocks 503 to rotate. As a result, the right-angle notch on each circular limiting block 503 is disengaged from the corresponding extension frame 4021, so that the lifting frame assembly 4 is lifted upwards to drive the tensioning roller assembly 7 to move upwards, thereby facilitating threading operations. Moreover, during the upward movement of the tensioning roller assembly 7, the two support roller assemblies 2 are driven to move away from each other and expand by virtue of the linkage assembly 3. When it is necessary to adjust an angle between the two support roller assemblies 2 and the support frame 1, the first adjusting bolt 302 is rotated, so that the expansion clamping ring 3021 is separated from the clamping block 304, and the lock between the cylinder 3011 and the annular protrusion 7021 is released. Then, the two support roller assemblies 2 are rotated to an appropriate angle, and the first adjusting bolt 302 is rotated to drive the expansion clamping ring 3021 to move, thereby driving the clamping block 304 to rotate. In this way, the rotation between the cylinder 3011 and the annular protrusion 7021 is restricted by the clamping block 304. The second adjusting bolt 604 is rotated to drive the movable strip 602 in the strip-shaped frame 601 to move. Combined with the action of the waist-shaped hole 6021 and the linkage pin, a relative angle between the yarn guiding assembly 603 and the strip-shaped frame 601 is adjusted, resulting in a specific pulling effect on the yarn as it passes through.

The spatially relative terms such as "arranged above", "arranged on", "arranged on an upper surface of" and "above" are used for the convenience of describing the present application, and are intended to describe spatial positional relationships between a device or feature and other devices or features as shown in the drawings. It should be understood that the spatially relative terms are intended to include different orientations of components in use or operation in addition to the orientation described in the drawings. For example, if the component in the accompanying drawings is inverted, the component described as "above other components or structures" or "on other components or structures" will be positioned as "below other components or structures" or "under other components or structures". Thus, the exemplary term "above" can encompass both orientations of "above" and "below". The component can also be oriented in other directions (rotated 90° or at other orientations), with corresponding interpretations of the spatially relative descriptions.

It should be noted that the terms used herein are merely for describing specific embodiments, and cannot be construed as a limitation of the present application. As used herein, unless the context clearly dictates otherwise, the singular forms are intended to include the plural forms. Furthermore, it should be understood that the terms "comprise" and/or "include" used in the present disclosure indicate the presence of features, steps, operations, devices, components, and/or combinations thereof.

It should be noted that terms "first", "second", etc. in the specification and claims of this application are adopted to distinguish similar objects, and are not necessarily adopted to describe a specific order or sequence. It should be understood that the terms used in this way are interchangeable where appropriate, so that the embodiments of the present disclosure described herein can, for example, be implemented in an order other than those illustrated or described herein. In addition, terms "include" and "have" and any variations thereof are intended to cover non-exclusive inclusions. For example, a process, method, system, product or device that includes a series of steps or units is not necessarily limited to those steps or units clearly listed, but may include other steps or units that are not clearly listed or inherent to these processes, methods, products or devices.

The embodiments described above are merely illustrative of the present disclosure, and are not intended to limit the patent scope of the present disclosure. Various modifications and replacements made by those skilled in the art without departing from the spirit of the disclosure shall fall within the scope of the present disclosure defined by the appended claims.

What is claimed is:

1. A device for controlling yarn feeding tension of a false-twist texturing machine, comprising:

a support frame;

wherein a first support roller group and a second support roller group are symmetrically and rotatably arranged at a first side and a second side of the support frame, respectively; an inner side of the support frame is slidably provided with a tensioning roller assembly; the support frame is slidably provided with a lifting frame assembly, and the lifting frame assembly is configured to drive the tensioning roller assembly to move upward; and a first dustproof cover assembly and a second dustproof cover assembly are symmetrically arranged on tops of the first side and the second side of the support frame, respectively;

the tensioning roller assembly comprises a tensioning roller, and a plurality of annular guide channels are arranged evenly spaced apart on an outer peripheral surface of the tensioning roller; and a first end and a second end of the tensioning roller are each provided with a slider, a third side and a fourth side of the support frame are each provided with a rectangular slideway fitting the slider, and the slider is provided with an annular protrusion coaxial with the tensioning roller;

a first linkage assembly is arranged at the annular protrusion corresponding to the first end of the tensioning roller; a second linkage assembly is arranged at the annular protrusion corresponding to the second end of the tensioning roller; and the first linkage assembly and the second linkage assembly are configured to move up and down with the tensioning roller assembly to drive the first support roller group and the second support roller group to switch between an unfolded state and a folded state;

each of the first linkage assembly and the second linkage assembly comprises a cylinder rotatably arranged in the annular protrusion; an end of the cylinder is fixedly provided with a fan-shaped block; two edges of a side of the fan-shaped block are symmetrically and rotatably provided with two linkage arms; an end of one of the two linkage arms away from the fan-shaped block is rotatably connected to a side wall of the first support roller group, and an end of the other of the two linkage arms away from the fan-shaped block is rotatably connected to a side wall of the second support roller group; a locking assembly is provided inside the cylinder, and is configured to limit rotation of the cylinder relative to the annular protrusion; an inner side of each of the first support roller group and the second support roller group is rotatably provided with a tensioning assembly; the tensioning assembly comprises a strip-shaped frame; an inner side of the strip-shaped frame is slidably provided with a movable strip; and a side of the strip-shaped frame is rotatably provided with a plurality of yarn guiding assemblies; and the fan-shaped block is provided with a screw hole coaxial with the cylinder; the locking assembly comprises a first adjusting bolt rotatably arranged in the screw hole;

the first adjusting bolt is insertedly arranged in the cylinder; an end of the first adjusting bolt close to an inner side of the cylinder is rotatably provided with an expansion clamping ring; the expansion clamping ring has a truncated cone structure; an outer peripheral surface of the cylinder is provided with a strip-shaped notch; a clamping block is hingedly provided inside the strip-shaped notch; and a side surface of the clamping block close to the expansion clamping ring is configured to be inclined.

2. The device of claim 1, wherein the support frame has a U-shaped structure; a top of the support frame is provided with a reinforcement rod; and two edges of each of the third side and the fourth side of the support frame are symmetrically provided with two lug blocks, respectively.

3. The device of claim 2, wherein the lifting frame assembly comprises a portal frame slidably arranged at an outer side of the support frame; two sides of the portal frame are each provided with a strip-shaped slideway corresponding to the rectangular slideway; a position of each of the two sides of the portal frame adjacent to the strip-shaped slideway is provided with an extension frame; a pressing assembly is provided inside the extension frame, and is configured to apply a pressure to the tensioning roller assembly; the pressing assembly comprises an abutting block slidably arranged in the extension frame; a lower portion of the abutting block is provided with an arc-shaped notch fitting the annular protrusion; an upper portion of the abutting block is provided with a guide rod; an upper portion of the extension frame is provided with a guide hole for the guide rod to pass through, and a position of an outer peripheral surface of the guide rod close to an inner side of the extension frame is sleevedly provided with a spring; and both sides of the upper portion of the extension frame each have a right-angle structure.

4. The device of claim 3, wherein each of the first support roller group and the second support roller group comprises a roller frame rotatably connected to the two lug blocks, two support arms and a support roller; and the two support arms are respectively arranged at two ends of the roller frame; and ends of the two support arms away from the roller frame are fixedly connected to the support roller.

5. The device of claim 4, wherein each of the first dustproof cover assembly and the second dustproof cover assembly comprises a dustproof bent plate; a side of the dustproof bent plate is provided with a metal rotating rod, and the metal rotating rod is rotatably connected to an upper portion of the inner side of the support frame; two ends of the metal rotating rod pass through the third side and the fourth side of the support frame, respectively; the two ends of the metal rotating rod are each eccentrically and fixedly connected to a circular limiting block; and an outer edge of the circular limiting block is provided with a right-angle notch.

6. The device of claim 5, wherein the number of the plurality of yarn guiding assemblies is the same as the number of the plurality of annular guide channels; a first end of the strip-shaped frame is provided with a first rotating pin, and a second end of the strip-shaped frame is provided with a second rotating pin; one of the two support arms is provided with a first pin hole for the first rotating pin to pass through, and the other of the two support arms is provided with a second pin hole for the second rotating pin to pass through; and one of the first rotating pin and the second rotating pin is provided with a through hole communicated with the inner side of the strip-shaped frame; an inner side of the through hole is provided with a second adjusting bolt; an end of the movable strip is provided with a threaded hole; and the second adjusting bolt is in threaded fit with the threaded hole.

7. The device of claim 6, wherein each of the plurality of yarn guiding assemblies comprises a bent block rotatably connected to a side wall of the strip-shaped frame;

each of two ends of the bent block is provided with a bent portion bent toward the strip-shaped frame; the bent portion is fixedly provided with a first metal shaft; a first side wall of the bent block is fixedly provided with a side plate, and the side plate is fixedly provided with a second metal shaft; and each of the first metal shaft and the second metal shaft is rotatably provided with a V-groove pulley.

8. The device of claim 7, wherein a second side wall of the bent block is provided with a linkage pin, and the linkage pin is insertedly arranged in a waist-shaped hole.

9. The device of claim 7, wherein a lower portion of the support frame is provided with a mounting hole for fixing the support frame.

* * * * *